US008984790B2

(12) United States Patent
Wilson et al.

(10) Patent No.: US 8,984,790 B2
(45) Date of Patent: Mar. 24, 2015

(54) ADJUSTABLE CHEEK REST

(71) Applicant: Sig Sauer, Inc., Newington, NH (US)

(72) Inventors: John Wilson, East Waterboro, ME (US); David C. Johnson, New London, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/153,005

(22) Filed: Jan. 11, 2014

(65) Prior Publication Data

US 2014/0196343 A1 Jul. 17, 2014

Related U.S. Application Data

(60) Provisional application No. 61/751,475, filed on Jan. 11, 2013.

(51) Int. Cl.
*F41C 23/14* (2006.01)

(52) U.S. Cl.
CPC ..... *F41C 23/14* (2013.01)
USPC ..... 42/73

(58) Field of Classification Search
USPC ..... 42/71.01, 71.02, 72, 73, 74, 1.06, 90
See application file for complete search history.

(56) References Cited

U.S. PATENT DOCUMENTS

| | | | | | |
|---|---|---|---|---|---|
| 717,011 | A * | 12/1902 | Marsland et al. | ..... | 42/71.01 |
| 737,732 | A * | 9/1903 | Gaut | ..... | 42/71.01 |
| 1,032,628 | A * | 7/1912 | Sherman | ..... | 42/74 |
| 1,651,299 | A * | 11/1927 | Stansel | ..... | 42/73 |
| 2,100,514 | A * | 11/1937 | Miller et al. | ..... | 42/71.01 |
| 2,432,519 | A * | 12/1947 | Garand | ..... | 42/71.01 |
| 2,669,051 | A * | 2/1954 | Cline | ..... | 42/71.01 |
| 3,710,496 | A * | 1/1973 | Packmayr et al. | ..... | 42/71.01 |
| 4,122,623 | A * | 10/1978 | Stice | ..... | 42/73 |
| 5,149,899 | A * | 9/1992 | Dabrowski | ..... | 42/72 |
| 5,235,764 | A * | 8/1993 | Perazzi | ..... | 42/73 |
| 5,970,642 | A * | 10/1999 | Martin | ..... | 42/73 |
| 7,640,688 | B2 * | 1/2010 | Oz | ..... | 42/73 |
| 7,930,849 | B2 * | 4/2011 | Abraham et al. | ..... | 42/73 |
| 2005/0241205 | A1 * | 11/2005 | Rotundo | ..... | 42/71.01 |
| 2009/0288324 | A1 * | 11/2009 | Peterson et al. | ..... | 42/75.03 |
| 2012/0110884 | A1 * | 5/2012 | Criswell | ..... | 42/73 |
| 2014/0245649 | A1 * | 9/2014 | Fluhr et al. | ..... | 42/73 |

FOREIGN PATENT DOCUMENTS

| | | | | |
|---|---|---|---|---|
| DE | 3743092 | A1 * | 7/1988 | ..... F41C 23/00 |

* cited by examiner

*Primary Examiner* — Jonathan C Weber
(74) *Attorney, Agent, or Firm* — Finch & Maloney PLLC

(57) ABSTRACT

A locking adjustable cheek rest comprising an upper U-shaped portion and a lower portion located on the stock of a rifle or other firearm. The U-shaped portion is biased against the lower portion, such that the walls of the U-shaped upper portion press against the lower portion, thereby locking the upper portion in position. A first release and a second release are depressed to release the bias and enable the upper portion to be raised and lowered relative to the lower portion. Interlocking mechanisms located on the upper and lower portions facilitate locking of the cheek rest in a position determined by the user.

16 Claims, 4 Drawing Sheets

ADJUSTABLE CHEEK REST

RELATED APPLICATION

This application claims benefit of U.S. Provisional Patent Application Ser. No. 61/751,475, titled "ADJUSTABLE CHEEK REST" filed Jan. 11, 2013

BACKGROUND

1. Field of Invention

This disclosure relates to a cheek rest on a rifle or other firearm and more particularly to a locking and adjustable mechanism for repositioning the cheek rest using a pinching grip.

2. Discussion of Related Art

Cheek rests or cheek pads have been in use for many years on rifles and shotguns. Adjustable cheek rests allow a user to customize the height of the cheek rest based on user preference and sight alignment requirements. A standard stock or buttstock does not consider the size and shape of the shooter, or the various scope mounts or aiming sights that may be employed by the user on their rifle. Accordingly, an adjustable cheek rest enables a user to customize the height of the cheek rest in order to best fit the user and the equipment. Many cheek rests are stationary and do not feature the ability to be customized in height to the preference of the user. Additionally, those that are adjustable (capable of being raised and lowered) often require tools or two hands in order to adjust the height of the cheek rest.

SUMMARY OF THE INVENTION

The present disclosure describes a locking adjustable cheek rest for use on a rifle, the locking adjustable cheek rest comprising an upper U-shaped portion in an inverted position that is configured to essentially surround a lower portion located on the stock of a rifle or other firearm. The U-shaped portion is biased against the lower portion, such that the sides of the U-shaped upper portion press against the sides of the lower portion, thereby locking the upper portion in position. A pair of releases can be depressed to counter the bias and enable the upper portion to be raised and lowered relative to the lower portion. The upper portion may also include an integrated spring clip that can provide or add to the bias required to adequately grip the lower portion. An interlocking mechanism between on the upper and lower portions may facilitate locking of the cheek rest in a position determined by the user.

In one aspect an adjustable cheek rest for a firearm is provided, the cheek rest comprising a lower portion attached to or integral to the stock of a firearm, the lower portion defining a slot passing there through and having an outer surface, a resilient upper portion separable from the lower portion, the upper portion having a cross-sectional U shape including an open end and a curved end, the U-shaped upper portion having two sides each defining an aperture there through, the resilient upper portion exhibiting a preferred shape wherein an interior dimension between the two sides is less than a corresponding exterior dimension of the lower portion, and a compressible release mechanism configured to pass through the slot and the two apertures, wherein the release mechanism in an extended position allows the upper portion to grip the lower portion and when in a compressed position outwardly deforms the open end of the upper portion to release the grip and allow the upper portion to slide in relation to the lower portion.

In another aspect a method of adjusting a cheek rest for a firearm is provided, the method comprising pinching together two knobs positioned on opposing ends of a release mechanism, forcing the sides of a resilient cheek rest outwardly from a stock of the firearm, sliding the resilient cheek rest vertically from a first vertical position while pinching the knobs of the release mechanism, and releasing the knobs of the release mechanism to secure the resilient cheek rest in a second vertical position.

DESCRIPTION OF THE DRAWINGS

These and other features and advantages of the present invention will be better understood by reading the following detailed description, taken together with the drawings wherein.

DETAILED DESCRIPTION

In one aspect, the present disclosure is directed to an adjustable cheek rest that can be operated with one hand, can offer ambidextrous design, and is capable of adjusting to a plurality of heights and maintaining the chosen height in a fixed manner until the user decides to alter the height of the cheek rest. Cheek rest height adjustment may be particularly useful when the user is changing firing positions, such as from standing to prone. The cheek rest may have three or more parts, including an upper removable portion, a lower portion attached to the stock of the firearm, and a release mechanism for securing the upper portion to the lower portion and releasing the upper portion from the lower portion. The upper portion may be made of a resilient material that has a memory that returns it to its original shape after minor deformation. As used herein, a resilient material is one that can be flexed to change a dimension of the piece by at least 5% yet returns to its original shape after the flexing force is released. The resilient upper portion can provide enough clamping force when fitted over the lower portion that the upper portion will remain fixed in relation to the stock when used under typical firing conditions. The release mechanism can be configured so that when the release mechanism is compressed, e.g., between a thumb and forefinger, the upper portion is expanded, releasing its grip on the lower portion and allowing the upper portion to be moved in relation to the stock. Thus, although the release mechanism passes through apertures in the walls of the upper portion, a decrease in the length of the release mechanism increases, temporarily, the distance between the walls of the upper portion.

Figure 1:
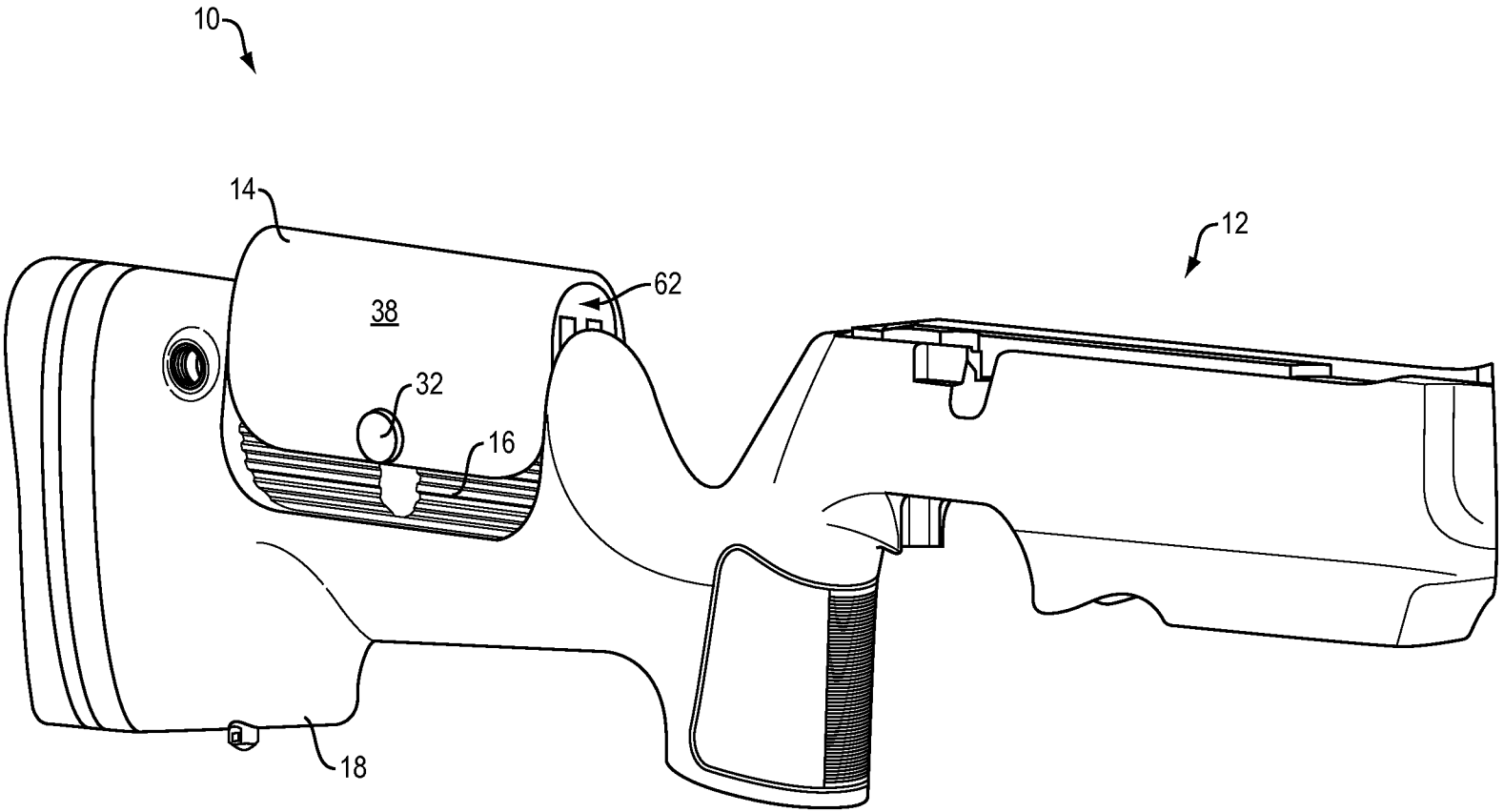
FIG. 1 is a detailed view of the cheek rest on a stock according to one embodiment of the present invention.

One embodiment is illustrated in FIG. 1. An adjustable cheek rest 10 for a rifle 12 is released for repositioning by applying a pinching grip across knobs 32 and 26 (see FIG. 3). The cheek rest can be freely repositioned while maintaining that grip, and secured in position by the act of releasing the knobs. In some cases, the cheek rest may be repositionable along only one axis, for example a vertical axis that is essentially normal to the axis of the firearm. The adjustment of the cheek rest does not require any tools and can be fully operated with one hand. The adjustable cheek rest allows the user to adjust the cheek rest to provide the correct alignment of eye and rifle sight as needed, particularly each time a shooting position is established. The adjustable cheek rest can also allow for lowering or removal of the cheek rest when a user needs to remove the bolt of a bolt action rifle for ease of cleaning the rifle barrel.

Figure 2:
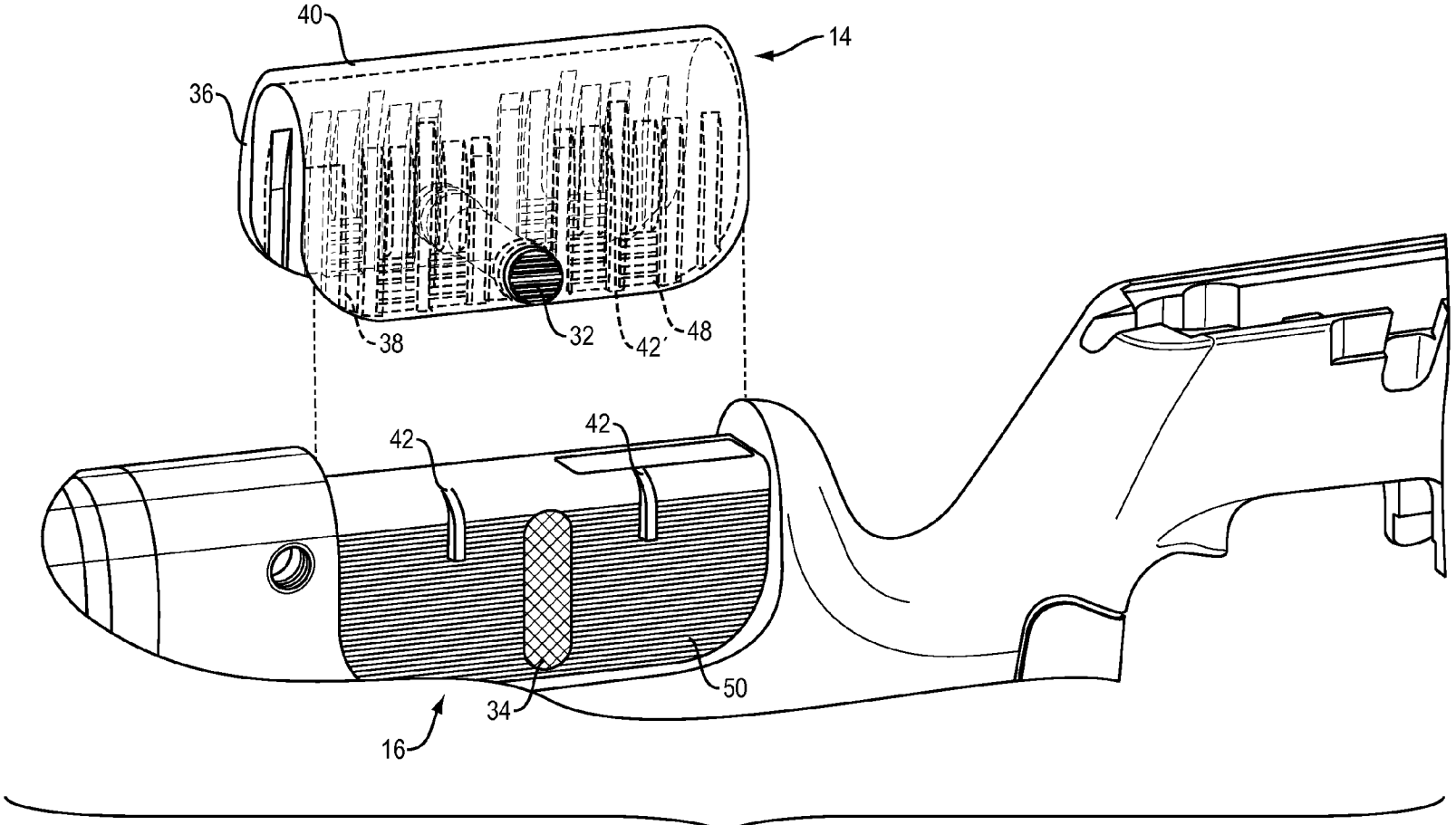
FIG. 2 is a deconstructed view of the upper portion of the cheek rest shown independent from the rifle according to one embodiment of the present invention.
Figure 3:
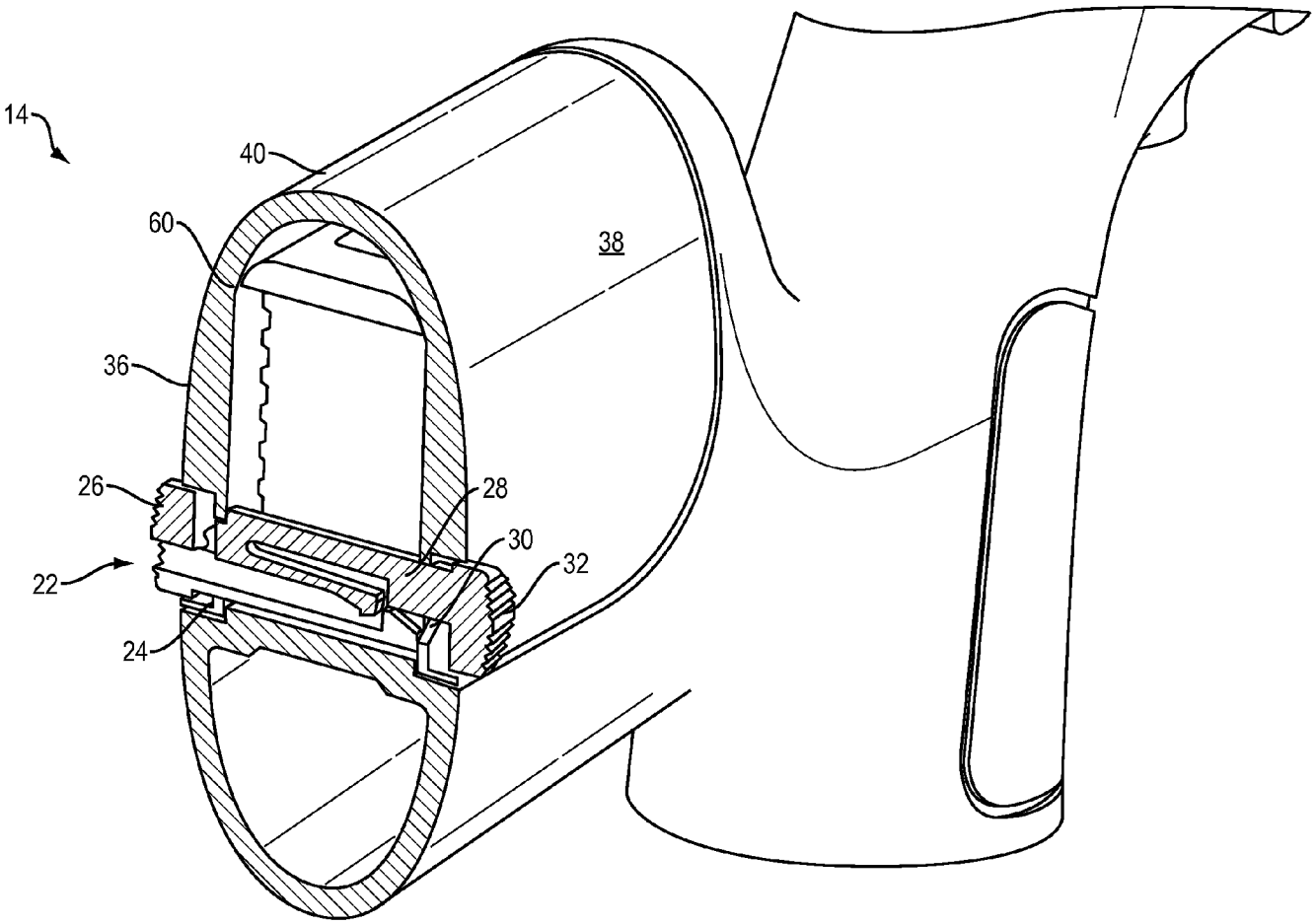
FIG. 3 is a cross-sectional view of the cheek rest detailing the internal connections of the upper and lower portions and the release mechanism according to one embodiment of the present invention.

The cheek rest includes an upper portion 14, shown semi-transparent in FIG. 2, which operates in conjunction with a lower portion 16. The lower portion 16 is connected to the stock or buttstock 18 of the rifle 12. Lower portion 16 may be integral to the stock, meaning that it is formed from a common piece, or it may be formed separately and attached to the stock, such as with screws or adhesive. Upper portion 14, in cross-section, is a parabolic upside-down U-shape with a first side 36, a second side 38, and a connector portion 40, wherein the first and second side 36/38 and the connector portion 40 are connected to one another via a continuous piece of material to form the U-shaped upper portion 14. Sides 36 and 38 may be substantially planar while connector portion 40 is substantially parabolic, as shown. At curvature point 60 (FIG. 3), the upper portion transitions from substantially planar to curved. The upper portion is configured to be placed onto the lower portion such that the U-shape is situated in an inverted manner. When in its lowermost position, as shown in FIG. 3, curvature point 60 is approximately even with the top of lower portion 16. When upper portion 14 is raised or partially raised, as in FIG. 1, void 62 becomes larger.

Upper portion 14 of the cheek rest can be a single design element and may be made using a plastic molding process such as injection molding. The plastic may be hypoallergenic and can include fillers and additives such as pigments, UV inhibitors, plasticizers, glass or carbon fibers and fluorescent materials. Appropriate polymers are known to those of skill in the art and include polyolefins, polycarbonate, ABS and fiberglass reinforced plastics. The upper portion (in particular the lower edges of the upper portion) of the cheek rest can be shaped to provide a biasing force against the sides of the lower portion of the buttstock, or alternately can be shaped to require a bolt and nut in the place of the first and second releases 22/28 to bias and secure the upper portion of the cheek rest against the lower portion on the buttstock. The molding process of the cheek rest may be carried out so that the first side 36 and second side 38 are substantially parallel to one another when pulled from the mold and not fully cured. While the part is still warm and shapable, the two sides 36 and 38 can be compressed towards one another so that the dimension across the open end of the U is reduced. The part can then be fully cured and/or cooled while held in a compressed state. Upon release of the external compression force, the cured piece will have a preferred shape, in the absence of external forces, where the dimension across the open end of the U is less than or equal to the dimension across lower portion 16. Thus, to be fitted over lower portion 16, upper portion 14 can be expanded, or pulled apart, and then allowed to contract after placement on lower portion 16. This means that upper portion 14 will be in compression around lower portion 16 and will provide a gripping function around lower portion 16. Thus, in this embodiment, the upper portion exhibits a "spring clip" function without requiring any additional components.

In an alternate embodiment (not shown), a U-shaped or saddle-shaped spring clip can be used within the mold or on an internal surface of the mold, such that the spring-clip passes over the comb of the upper portion and is self-biased against the left and right sides of the stock. This bias is used to secure the upper portion of the cheek rest to the lower portion within a limited range of relative position. In these cases, the plastic itself need not have memory and can be flexible. The spring clip can be integrated into the upper portion and thus not visible when the cheek rest is in use. The spring clip may be removable or premanently molded into the upper portion.

A release mechanism for securing and releasing the upper portion may include two or more parts, or releases. A first release 22, FIG. 3, is configured to pass through a first aperture 24 on a first side 36 of the upper portion 14, through slot 34 on lower portion 16 and contact an interior surface of a second side 38 of upper portion 14. First knob 26 of the first release 22 is larger in diameter than at least a portion of the first aperture 24 and therefore the first knob 26 remains exposed on an exterior of the first side 36 of the upper portion 14. Similarly, a second release 28 is configured to pass through a second aperture 30 on a second side 38 of the upper portion 14, through slot 34 and contact an interior surface of the first side 36 of the upper portion 14. A second knob 32 of the second release 28 is larger in diameter than at least a portion of the second aperture 30 and therefore the second knob 32 remains exposed on an exterior of the second side 38 of the upper portion 14. In some embodiments apertures 24 and 30 can be of two or more diameters. For example, an outward facing portion of apertures 24 and 30 may be of large enough diameter to allow the passage of knobs 26 and 30 while an inward facing portion of apertures 24 and 30 may have smaller diameters, allowing for the passage of releases 22 and 28 while preventing the passage of knobs 26 and 32. Apertures 24 and 30 may have, for example, two distinct cylindrical diameters as shown, or may be conically shaped to provide a variation in diameter.

Depressing the exposed first and second knobs 26/32 of both the first and second releases 22/28 at the same time, using a pinching grip with the user's hand, pushes at least a portion of the inner surfaces of sides 36 and 38 away from each other, allowing the user to release the gripping bias created by the upper portion 14. This enables the user to move upper portion 14 upward or downward in relation to lower portion 16 on the buttstock 18. The pinching grip allows the user to move the cheek rest into a new position, whereby it is secured simply by the letting go of the first and second knobs 26/32 of both the first and second releases 22/28, thereby allowing the upper portion 14 to again bias against the sides of the lower portion 16. The adjustment can be completed without tools and without disconnecting or reconnecting parts. The force needed to depress the first and second releases 22/28 may be, for example, between 5 and 20 lbs of force, preferably about 13 lbs of force, such that a user can depress the first and second releases 22/28 relatively easily between the thumb and forefinger of one hand. The opposing force can be provided by the sides of upper portion 14, which can be in compression around lower portion 16.

Figure 4:
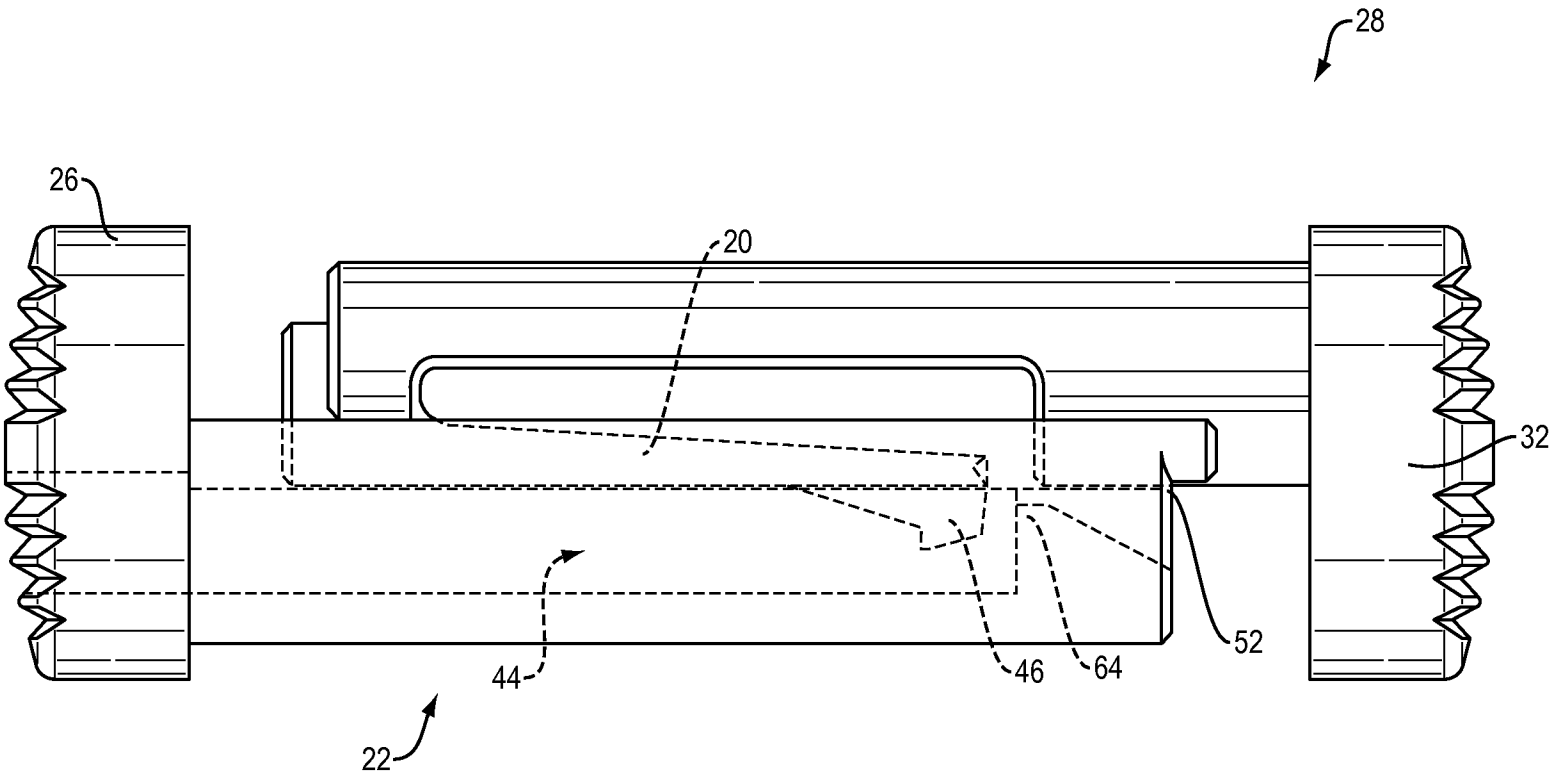
FIG. 4 is a detailed view of the connection between the first release and the second release according to one embodiment of the present invention.

First and second releases 22/28, as shown in FIG. 4, can be interlocked to one another to form a release mechanism. In the embodiment shown, at least one of the first and second releases includes an integral spring clip 20 (shown on second release 28 in FIG. 4). The integral spring clip 20 can retain the two releases together while providing a path of substantially axial motion of the two releases in relation to each other. Thus, the manual compression of opposing knobs 26 and 32 can move the two releases axially in relation to each other, but the compression force provided by the opposed sides 36 and 38 of upper portion 14 forces the knobs back to their original position after the knobs are released by the operator. As the interior surface of the opposed sides 36 and 38 are in contact with distal ends of releases 22 and 28, the compression force provided by the deformation of upper portion 14 can place the release mechanism in tension, pushing knobs 26 and 32 outwardly.

First and second releases 22/28 can be physically separated from one another in order to remove the upper portion 14 of cheek rest 10. In one embodiment, the first and second releases 22/28 are separated from one another using, for example, a 3 mm pin or Allen key, inserted through opening 44 and pressed against end portion 46 of the integral spring clip 20. The pin raises end portion 46 by sliding along the angled lower edge of end portion 46 until end portion 46 is raised to a height adequate to clear lip 64 of release 22. Other separation and removal options, such as various pins or fasteners are also contemplated and within the scope of the present invention. The release and connection between the first and second releases 22/28 may be a dovetail connection 52 that enables the first and second releases 22/28 to slide relative to one another when the first and second knobs 26/32 are depressed and released. When the first and second releases 22/28 are separated from one another, the dovetail connection 52 can disengage.

The cheek rest can include an interlocking feature that helps fix upper portion 14 in relation to lower portion 16 when the release is depressed by the user. As shown in FIG. 2 an interlocking mechanism can include features on the inner surface of upper portion 14 that complement features on the outer surface of lower portion 16. For example, the interior surface of upper portion 14 can include raised or depressed features such as protrusions 48 and/or grooves, which can be in a repeated pattern, such as a series of ribs or teeth that are integral with the interior surface. Lower portion 16 can also include raised or depressed features 50, such as ribs or teeth configured to complement and interlock with protrusions 48 on upper portion 14. When protrusions 48 of upper portion 14 are engaged with grooves 50 of lower portion 16, the cheek rest is in a stable or locked position. The configuration of the interlocking mechanism can allow the cheek rest to be positioned in a plurality of different locations, thereby fully customizing the height of the cheek rest based on the preference of the user. When the user depresses first and second releases 22/28, protrusions 48 and grooves 50 disengage from one another and upper portion 14 can be freely raised or lowered with respect to lower portion 16. Releasing the first and second releases 22/28 will then reengage or lock the first and second interlocking mechanisms 48/50 to one another, securing the cheek rest in the a second position determined by the user. In many embodiments the height of the protrusions extending from the surface of lower portion 16 may be less than the length of travel afforded to the release mechanism. In this manner, full compression of the release mechanism will fully clear the interlocking features, allowing upper portion 14 to slide smoothly up or down. Lower portion 16 may also include indicia that can be aligned with the lower edge of the upper portion to help a user re-adjust the cheek rest exactly to a previously used height.

The cheek rest may also include one or more guides 42 and 42' on the upper portion and/or lower portion, which restrict relative rotation or horizontal movement of the cheek rest and/or restrict repositioning of the cheek rest to a single axis of travel. Guide members 42 and 42' may be complementary to each other and can also serve to provide rigidity to resilient upper portion 14.

It is also contemplated and within the scope of the present invention that a similar adjustable and biased mechanism could be used with a recoil pad or forearm and be configured to similarly adjust.

It is understood that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention and not to be limited except by the allowed claims and their legal equivalents.

What is claimed is:

1. An adjustable cheek rest for a firearm, the cheek rest comprising:

a lower portion attached to or integral to a stock of a firearm, the lower portion defining a slot passing there through and having an outer surface;

a resilient upper portion separable from the lower portion, the upper portion having a cross-sectional U shape including an open end and a curved end, the U-shaped upper portion having two sides each defining an aperture there through, the resilient upper portion exhibiting a preferred shape wherein an interior dimension between the two sides is less than a corresponding exterior dimension of the lower portion; and a compressible release mechanism configured to pass through the slot and the two apertures, wherein the release mechanism in an extended position allows the upper portion to grip the lower portion and when in a compressed position outwardly deforms the open end of the upper portion to release the grip and allow the upper portion to slide in relation to the lower portion.

2. The cheek rest of claim 1 wherein the compressible release attaches the upper portion to the lower portion.

3. The cheek rest of claim 1 comprising an adjustable void between the upper portion and the lower portion.

4. The cheek rest of claim 1 wherein the upper portion includes protrusions or depressions on an inner surface that interact with complementary protrusions or depressions on the outer surface of the lower portion.

5. The cheek rest of claim 4 wherein the protrusions comprise a series of ridges.

6. The cheek rest of claim 1 wherein the cheek rest exhibits a range of vertical adjustment approximately equal to a length of the slot minus a diameter of the release.

7. The cheek rest of claim 1 wherein the release mechanism comprises a first release and a second release, the first release including a first knob and the second release including a second knob, the first knob extending outside of the aperture of one side and the second knob extending outside the aperture of the second side.

8. The cheek rest of claim 7 wherein the first release and the second release are slidable in relation to each other and are biased outwardly.

9. The cheek rest of claim 8 wherein the outwardly biased force is provided by the sides of the upper portion.

10. The cheek rest of claim 7 wherein the upper portion of the cheek rest is removed by disconnecting the first release from the second release.

11. The cheek rest of claim 1 wherein the upper portion is comprised of a hypoallergenic polymer having adequate rigidity to avoid collapse when supporting a user's cheek in a firing position.

12. The cheek rest of claim 1 wherein the lower portion is integral to the stock.

13. The cheek rest of claim 1 wherein the apertures are located on a lower half of the upper portion and the user's cheek does not contact the release mechanism when the firearm is supported against the user's cheek in a firing position.

14. The cheek rest of claim 1 wherein the lower portion includes guides designed to complement one or more guides on the inner surface of the upper portion such that the interaction there between limits movement of the upper portion to a substantially vertical direction.

15. The cheek rest of claim 1 wherein the upper portion includes a spring clip to bias the upper portion in the preferred shape.

16. The cheek rest of claim 1 wherein the upper portion consists essentially of a homogeneous polymeric material.

* * * * *